US006385933B1

(12) United States Patent
Owens

(10) Patent No.: US 6,385,933 B1
(45) Date of Patent: May 14, 2002

(54) PRECAST WALL PANEL

(76) Inventor: George Owens, 8267 Mossy Oak Dr., Montgomery, AL (US) 36117

( * ) Notice: Subject to any disclaimer, the term of this patent is extended or adjusted under 35 U.S.C. 154(b) by 0 days.

(21) Appl. No.: 09/617,238

(22) Filed: Jul. 14, 2000

(51) Int. Cl.[7] ..... E04B 1/74

(52) U.S. Cl. ..... 52/404.5; 52/405.1; 52/251; 52/601; 52/602

(58) Field of Search ..... 52/292, 293.1, 52/293.2, 293.3, 295, 92.1, 92.2, 93.1, 404.2, 404.5, 415, 421, 441, 442, 309.11, 309.1, 309.4, 309.6, 309.7, 309.12, 223.1, 223.6, 223.7, 231, 340, 378, 405.3, 561, 563, 250, 251, 253, 596, 600–602, 405.1

(56) References Cited

U.S. PATENT DOCUMENTS 4,163,348 A * 8/1979 Thomas, Jr. ..... 52/241
5,201,786 A * 4/1993 Larsen ..... 52/227
5,531,054 A * 7/1996 Ramirez ..... 52/741.1
5,570,549 A * 11/1996 Lung et al. ..... 52/295
5,765,333 A * 6/1998 Cunningham ..... 52/481.1
5,871,307 A 2/1999 Catalano et al.
6,061,986 A * 5/2000 Canada ..... 52/561
6,161,339 A * 12/2000 Cornett, Sr. et al. ..... 52/23

* cited by examiner

*Primary Examiner*—Carl D. Friedman
*Assistant Examiner*—Yvonne M. Horton
(74) *Attorney, Agent, or Firm*—Nath & Associates PLLC; Gary M. Nath; Marvin C. Berkowitz

(57) ABSTRACT

A self sustaining, precast concrete wall panel for installation between a building roof structure and a building slab. The wall panel is reinforced by reinforcing rods configured in horizontal and vertical directions within the wall. To add stability to the wall panel a metal plate is placed on top of the wall panel and a wood plate is placed of top of the metal plate. The metal plate in sandwiched between the wood plate and the wall panel by threaded rods and nuts which are tightened on the rods which are embedded in the wall panel and runs vertically through both plates and protrudes through the top portion of the wall panel. A second rod protrudes through the bottom portion of the wall panel. The second rod is placed into holes provided in the floor and epoxied. Epoxy grout is used to fill voids between the wall panel and the slab providing stability to the wall panel. Finally, a ceramic insulation is sprayed on the inside portion of the wall panel to act as an insulator and is aesthetically pleasing enough to act as a finished wall as desired.

24 Claims, 3 Drawing Sheets

PRECAST WALL PANEL

FIELD OF THE INVENTION

The present invention relates in general to prefabricated wall panels which are usable as exterior walls in buildings. In particular, the present invention relates to precast wall panels which are made by pouring a material such as concrete into a form usually away from the installation site and after hardening can be shipped to the installation site and installed.

BACKGROUND OF THE INVENTION

Presently there is a need in the construction industry for low cost, strong, easy to install, precast wall panels. Many of the short falls of precast wall panels are that they are not strong or stable enough without additional structural support.

In order to overcome some of these shortfalls, prefabricated concrete walls were developed. However, prefabricated concrete walls are usually not very aesthetically pleasing and have poor heat insulation characteristics.

In order to overcome poor heat transfer characteristics of the prior art wall panels, insulation is needed. Some types of insulation that have been used are foam insulation which is sprayed between an inner wall and an outer wall and fiberglass insulation which comes in long sheets and is placed within the inner wall. The necessity for an inner wall adds an additional step which increases the cost of construction and increases both the time and materials needed.

Therefore, there is a need for a precast wall panel which eliminates the need for constructing an additional wall to protect the insulation and that will also be structurally sound enough to be able to withstand great loads.

SUMMARY OF THE INVENTION

The present invention overcomes the disadvantages of the prior art by providing a precast wall panel which is more structurally sound, has a one step method for providing proper insulation, that is aesthetically pleasing and which will eliminate the need to provide an extra wall to sandwich foam and fiberglass insulation. The precast wall panel is usually made away from the installation site, delivered to the site when needed and installed. However, it is also possible to cast the wall panels at the installation site.

These and other objects of the invention are achieved through a precast wall panel that can be installed between a footing having holes and a roof structure. The wall panel comprises a top portion,.a bottom portion, an inner surface, an outer surface, reinforcing rods located between said inner surface and the outer surface to provide support and stability to the wall panel thereby strengthening the wall panel. A first rod portion protrudes from the top portion so that the wall panel can be lifted. A second rod portion protrudes from the bottom portion to be placed in the holes provided in the footing to level and anchor the wall panel. The insulation is located on the interior surface of the wall panel wherein the insulation is a sprayed-on ceramic insulation having a desired color and texture which results in an appearance of a finished wall. Alternatively, the wall can be laminated with sheet rock if desired, such as in the case when additional insulation is desired.

In a specific embodiment, upon erection, the wall panel is further strengthened by a first plate, comprised of metal, located on the top portion of the present wall panel. A second plate made of wood is used to sandwich the first plate between the second plate and the top portion of the wall panel. The first rod portion protrudes through the second plate. A nut is located on the first rod portion which serves to secure the first plate to the wall panel and which further secures the second plate to the first plate.

In alternate embodiments, the second rod portion protrudes 6" from the bottom portion and further comprises a nut and washer located on the second rod portion for stabilizing and strengthening the wall panel.

Alternately, the precast wall panel is made of concrete and further comprises an electrical receptacle a switch box and an electrical conduit located between the inner and outer surfaces.

A method for forming a precast wall panel according to the present invention is also disclosed. The method comprises the steps of locating reinforcing rods in a form having a top and a bottom; locating a first rod portion such that it protrudes from the top of the form; locating a second rod portion such that it protrudes from the bottom of the form; and pouring a material that can harden into a hardened material having an inner surface, an outer surface, a top portion and a bottom portion into the form.

In alternate embodiments, the method can also include locating electrical receptacles, switch boxes and electrical conduits in the form before pouring the material.

DETAILED DESCRIPTION

Figure 1:
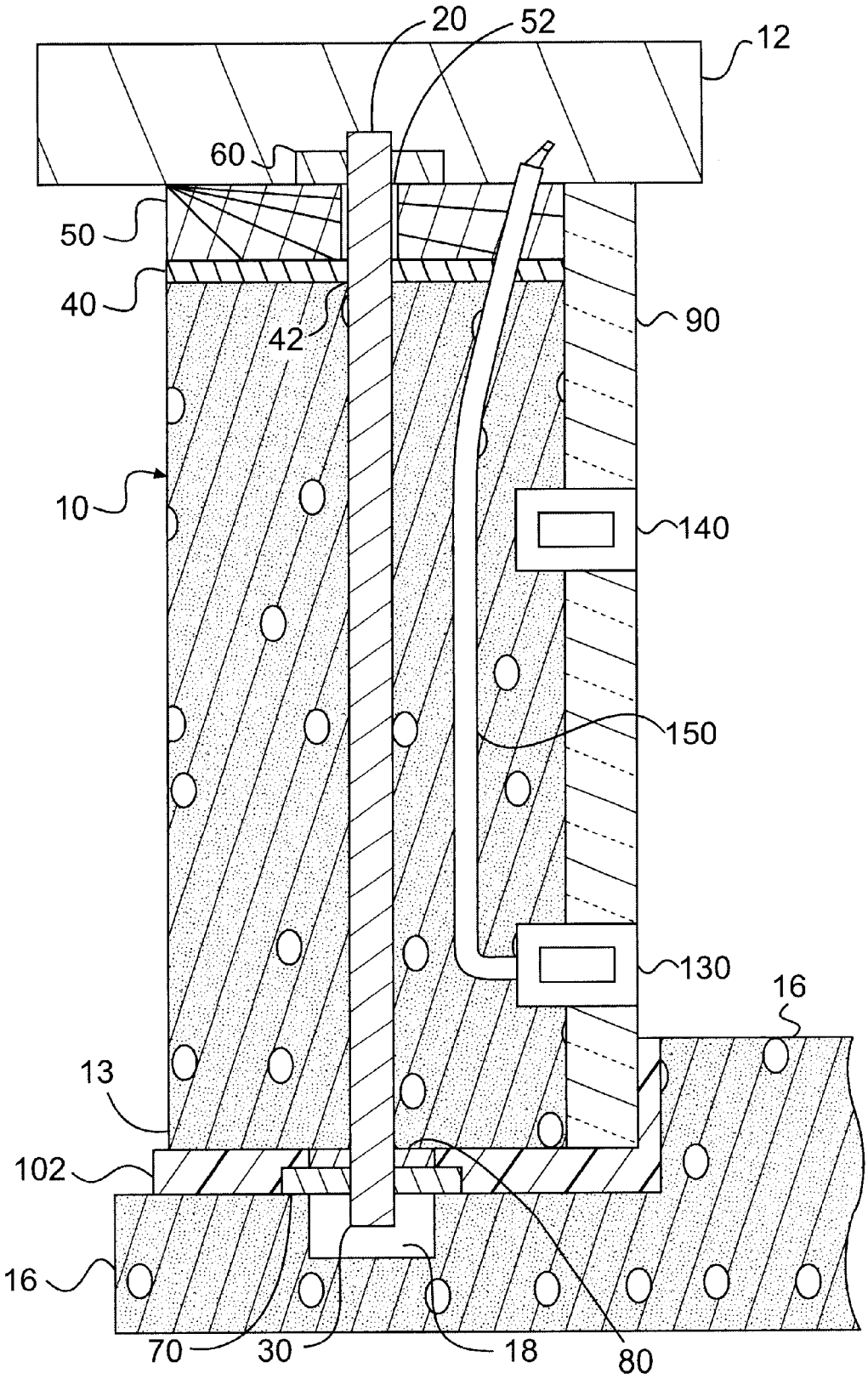
FIG. 1 is a side cross-section view of a precast wall panel of the invention.

The present invention is now described with reference to the drawings in which like elements are denoted by like numerals throughout the several views. In particular, with reference to FIGS. 1 and 2, an end elevation cross-sectional view and a front elevation cross-sectional view, respectively, of a precast wall panel 10 is depicted. Wall panel 10 can include a footing 13 and is depicted installed between a building's roof structure 12 and a building's slab 16. Slab 16 has a plurality of aligned floor holes 18.

Figure 2:
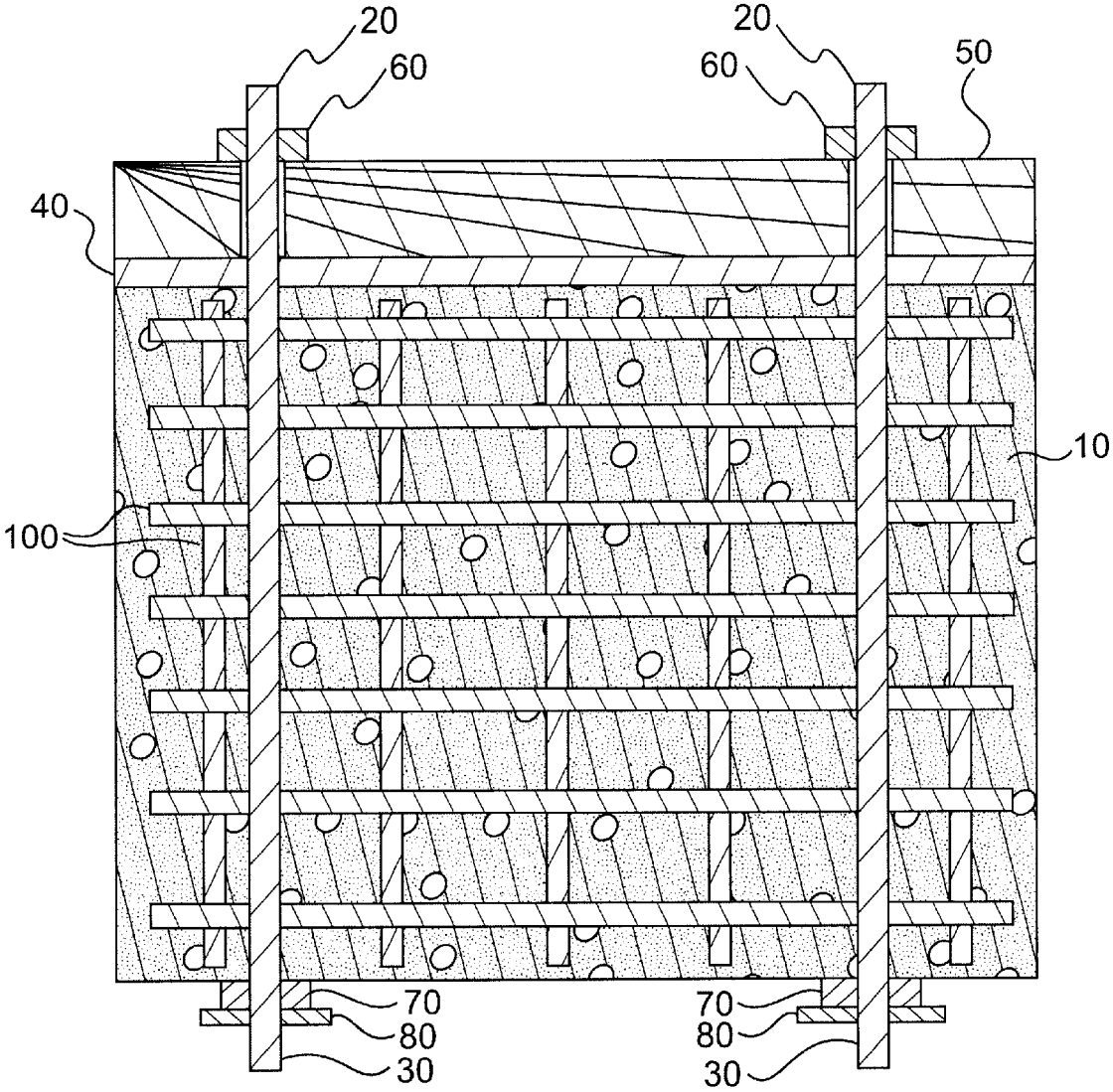
FIG. 2 is a front cross-sectional view of a precast wall panel of the invention.

Wall panel 10 has a first rod portion 20 protruding from the top of wall panel 10 and a second rod portion 30 protruding from the bottom of wall panel 10. A first plate 40, which can be metal, is located on top of wall panel 10 and a second plate 50 is located on top of first plate 40. A nut 60 is located on first rod portion 20 and a nut 70 and a washer 80 are located on second rod portion 30. An insulation layer 90 is located on an interior surface of wall panel 10. As depicted in FIG. 2, located within wall panel 10 are reinforcing rods 100.

Wall panel 10 is preferably concrete although it could be any other material such as plastic or metal.

First rod portion 20 protrudes from the top of wall panel 10 so that wall panel 10 can be lifted. First rod portion 20 is preferably a ¾" threaded rod and preferably protrudes 3" above the top of wall panel 10.

Second rod portion 30 protrudes from the bottom of wall panel 10 and fits into floor holes 18 to level and anchor wall panel 10. Second rod portion 30 is preferably a ¾" threaded rod and protrudes 6" from the bottom of wall panel 10. Nut 70 and washer 80 are located on second rod portion 30 and assist in leveling and anchoring wall panel 10. Epoxy grout 102 fills the void or space between the bottom of wall panel 10 and slab 16 in order to stabilize wall panel 10.

First plate 40 is located on top of wall panel 10 and is provided with a plurality of longitudinally aligned bores therethrough, bore 42 being exemplary. First rod portions 20 extend through corresponding ones of said bores 42. First plate 40 is preferably a 1/16th×4" metal plate. Located on top of first plate 40 is a second plate 50. Second plate 50 is provided with a plurality of longitudinally aligned bores therethrough, bore 52 being exemplary. First rod portions 20 extend through corresponding ones of said bores 52. Second plate 50 is preferably a 1½"×4" wood board. A nut 60 with a washer (not shown) is screwed on first rod portion 20 so as to bolt tight first plate 40 and second plate 50 to the top portion of wall panel 10. Thus first plate 40 is sandwiched between second plate 50 and wall panel 10, thereby anchoring and strengthening wall panel 10.

An insulation layer 90 is located on a the interior surface of wall panel 10. Preferably insulation layer 90 is a sprayed on ceramic cover insulation sprayed onto the interior surface of wall panel 10 to a thickness giving a sufficient insulating R-value to wall panel 10. For example, thicknesses of 6 mils or higher can be sprayed yielding R-values of at least 15. The ceramic insulation cover is of such quality that it can also act as a finished wall. Insulation layer 90 can be painted or wall papered to be aesthetically pleasing. Alternatively, insulation layer 90 can be conventional sheet rock.

Since insulation layer 90 acts as vapor barrier, moisture cannot penetrate the panel. The exterior of wall panel 10 can also be treated with a vapor barrier for the same reasons discussed above. It is also possible to stamp, texture and color the exterior wall into a brick face, wood grain design or other patterns that may be aesthetically pleasing.

Located inside wall panel 10 are reinforcing rods 100. Reinforcing rods 100 strengthen wall panel 10 and are preferably ⅜" reinforcing rods on 12" centers. Reinforcing rods 100 are preferably configured both in a vertical and a horizontal direction although they can also be placed in other configurations for structural stability.

Wall panel 10 can act as a structural support for roof trusses (not shown) which are attached to the 1½×4 inch wood second plate 50 at the top of wall panel 10.

Figure 3:
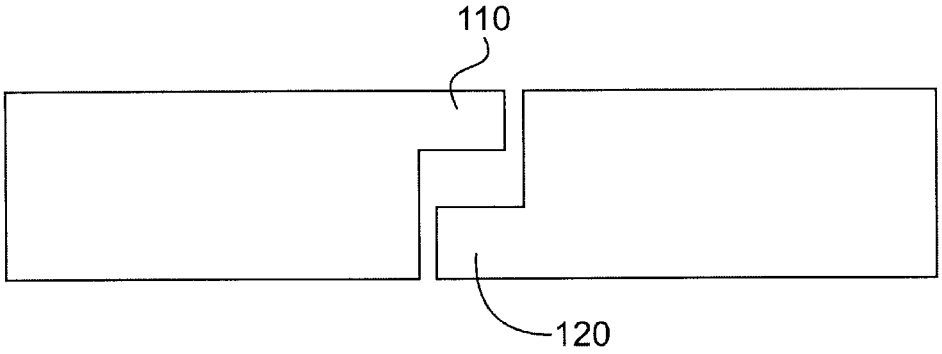
FIG. 3 is a top view of a precast wall panel joint of the invention.
Figure 4:
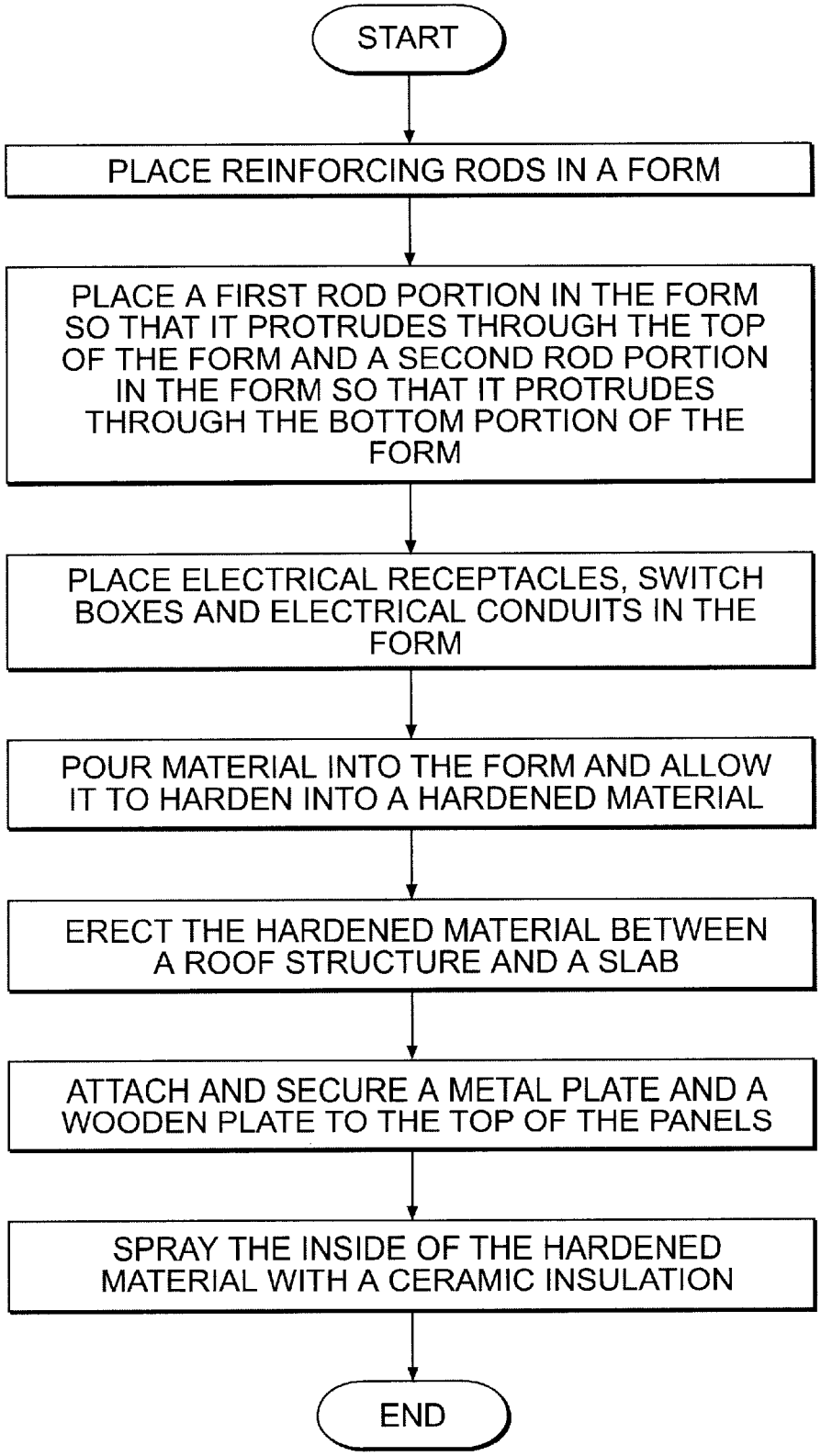
FIG. 4 is a flow diagram of the method for making a precast wall panel of the invention.

FIG. 3 is a plan view of a wall panel of the present invention having tabs 110 and 120 located at vertical edges of wall panel 10. Tabs 110 and 120 interlock to provide more stability to the wall panels when the wall panels are placed next to each other. Spaces located between the wall panels are filled with an expanding foam material (not shown) to add to the structural stability of the wall panels and also prevent air draft or leakage.

Tabs 110 and 120 are not limited to the shapes as depicted but can have any size or shape.

As shown in FIG. 2, the method of forming a precast wall panel comprises the steps of placing reinforcing rods 100, first rod portion 20 and second rod portion 30 into a form. Next, electrical receptacles 130, switch boxes 140 and electrical conduits 150 are placed in the form as shown in FIG. 1. A material, preferably concrete, is then poured into the form embedding all the aforementioned items into wall panel 10 except for portions first rod portion 20 and second rod portion 30 which partially protrude from the form.

Preferably, the form is initially in a horizontal position and reinforcement rods 100, first rod portion 20, second rod portion 30, electrical receptacles 130, switch boxes 140 and electrical conduits 150 are horizontally placed in the form.

Nut 70 and washer 80 are placed on second rod portion 30. Wall panel 10 is then lifted by first rod portion 20 into a vertical position. Second rod portion 30 is then placed in floor hole 18. Nut 70 and washer 80 are adjusted to level wall panel 10. Floor holes 18 are filled with epoxy grout to assist in stabilizing and strengthening wall panel 10.

After panel 10 has been erected, first plate 40 which is preferably a metal plate is placed on the top of wall panel 10. Second plate 50 is placed on top of first plate 40 and nut 60 is placed on first rod portion 20. Nut 60 is then tightened sandwiching first plate 40 between second plate 50 and wall panel 10 thereby strengthening wall panel 10.

As shown in FIG. 3, multiple wall panels formed in the above described manner are placed next to each other and expanding foam is used to fill spaces between the wall panels to moisture proof the panel joints. The wall panels have overlapping tabs 110 and 120 are providing increased stability and support.

The invention thus being described, it will be obvious that the same may be varied in many ways. Other variations are not to be regarded as a departure from the spirit and scope of the invention and all such modifications are intended to be included within the scope of the claims.

I claim:

1. A precast wall panel that can be installed in a vertical orientation between a lower slab and an upper roof structure of a building, the slab having holes, said wall panel comprising:

a top portion;

a bottom portion;

an inner surface;

an outer surface;

reinforcing rods located between said inner surface and said outer surface to provide support and stability to said wall panel thereby strengthening said wall panel;

a first rod portion protruding from said top portion;

a second rod portion protruding from said bottom portion to be placed in corresponding ones of the holes provided in the slab; and insulation located on said inner surface wherein said insulation is adapted to be a finished wall.

2. A precast wall panel as claimed in claim 1 wherein located on top of said top portion is a first plate having a plurality of orifices therethrough, corresponding ones of said first rod portions protruding through corresponding plate orifices.

3. A precast wall panel as claimed in claim 2 wherein said first plate is a metal plate.

4. A precast wall panel as claimed in claim 2 wherein located on top of said first plate is a second plate which is used to sandwich said first plate between said second plate and said top portion of said wall panel wherein said first rod portion protrudes through said second plate.

5. A precast wall panel as claimed in claim 4 wherein said second plate is a wood plate.

6. A precast wall panel as claimed in claim 5 wherein at least a part of said first rod portion is threaded and further comprising a nut threaded on said first rod portion and securing said first plate to said wall panel and said second plate to said first plate.

7. A precast wall panel as claimed in claim 1 wherein said insulation is a sprayed on ceramic insulation having a desired color and texture.

8. A precast wall panel as claimed in claim 1 wherein said second rod portion protrudes at least 6" from said bottom portion, and further including an adhesive located between said bottom portion of said precast wall panel and the slab.

9. A precast wall panel as claimed in claim 1 wherein at least a part of said second rod portion is threaded and further comprising a nut with a washer threaded on said second rod portion for leveling said wall panel.

10. A precast wall panel as claimed in claim 1 wherein the precast wall panel is a concrete precast wall panel.

11. A precast wall panel as claimed in claim 1 further comprising an electrical receptacle located in the precast wall panel.

12. A precast wall panel as claimed in claim 1 further comprising a switch box located in the precast wall panel.

13. A precast wall panel as claimed in claim 1 further comprising a electrical conduit located between said inner surface and said outer surface.

14. A precast wall panel as claimed in claim 1 further comprising a tab located on an edge of the precast wall panel, said tab being capable of engaging a tab of another precast wall panel to add stability and support to the wall panels.

15. A method for forming a precast wall panel comprising:

locating reinforcing rods in a form having a top and a bottom;

locating a first rod portion protruding from said top of said form;

locating a second rod portion protruding from said bottom of said form;

pouring a material into said form that hardens into a hardened material having an inner surface, an outer surface, a top portion and a bottom portion and forming tabs along vertical edges of said wall panel.

16. A method as claimed in claim 15 further comprising the step of locating an electrical receptacle in said form before pouring said material.

17. A method as claimed in claim 15 further comprising the step of locating a switch box in said form before pouring said material.

18. A method as claimed in claim 15 further comprising the step of locating an electrical conduit in said form before pouring said material.

19. A method as claimed in claim 15 further comprising the step of selecting concrete as the material for the form.

20. A method of installing a precast wall panel in a building having a roof portion and a slab, the method comprising:

locating reinforcing rods in a form having a top and a bottom;

locating a first rod portion protruding from said top of said form;

locating a second rod portion protruding from said bottom of said form; and pouring a material that hardens into a hardened material into said form and permitting said material to harden so as to create a formed wall having an inner surface, an outer surface, a top portion, a bottom portion, and tabs along vertical edges thereof; and placing said formed wall in an upright position between the slab and the roof portion whereby said tabs of said formed wall engage with corresponding tabs of an adjacent formed wall to form joints therebetween and to add to the stability of said wall panel.

21. A method as claimed in claim 20 further comprising applying a foam insulation to said formed joints to weather proof said formed joints.

22. A method as claimed in claim 20 wherein after said material hardens locating a first plate on said top portion of said hardened material.

23. A method as claimed in claim 22 wherein after said material hardens locating a second plate on top of said first plate.

24. A method as claimed in claim 23 wherein after said material hardens spraying a ceramic insulation onto an interior surface of said hardened material.

* * * * *